US005945964A

United States Patent [19]

DeGroot et al.

[11] Patent Number: 5,945,964

[45] Date of Patent: Aug. 31, 1999

[54] MULTI-BAND ANTENNA STRUCTURE FOR A PORTABLE RADIO

[75] Inventors: Robert J. DeGroot, Cary; James P. Phillips, Lake in the Hills, both of Ill.

[73] Assignee: Motorola, Inc., Schaumburg, Ill.

[21] Appl. No.: 08/801,975

[22] Filed: Feb. 19, 1997

[51] Int. Cl.[6] ..... H01Q 1/36; H01Q 1/24

[52] U.S. Cl. ..... 343/895; 343/702

[58] Field of Search ..... 343/702, 895, 343/900, 901, 725, 727, 853; H01Q 1/36, 1/24

[56] References Cited

U.S. PATENT DOCUMENTS

| | | | |
|---|---|---|---|
| 4,121,218 | 10/1978 | Irwin et al. | 343/702 |
| 4,222,053 | 9/1980 | Newcomb | 343/722 |
| 4,229,743 | 10/1980 | Vo et al. | 343/749 |
| 4,259,672 | 3/1981 | Newcomb | 343/722 |
| 4,442,438 | 4/1984 | Siwiak et al. | 343/792 |
| 4,725,845 | 2/1988 | Phillips | 343/702 |
| 4,868,576 | 9/1989 | Johnson, Jr. | 343/702 |
| 5,255,005 | 10/1993 | Terret et al. | 343/895 |
| 5,258,765 | 11/1993 | Dörrie et al. | 343/722 |
| 5,258,771 | 11/1993 | Praba | 343/895 |
| 5,274,388 | 12/1993 | Ishizaki et al. | 343/895 |
| 5,298,910 | 3/1994 | Takei et al. | 343/895 |
| 5,345,248 | 9/1994 | Hwang et al. | 343/895 |
| 5,353,036 | 10/1994 | Baldry | 343/702 |
| 5,469,177 | 11/1995 | Rush et al. | 343/895 |
| 5,504,494 | 4/1996 | Chatzipetros et al. | 343/895 |
| 5,572,224 | 11/1996 | Moller et al. | 343/702 |
| 5,572,227 | 11/1996 | Pal et al. | 343/727 |
| 5,583,520 | 12/1996 | Thill | 343/702 |
| 5,600,341 | 2/1997 | Thill et al. | 343/895 |
| 5,708,448 | 1/1998 | Wallace | 343/895 |
| 5,808,586 | 9/1998 | Phillips et al. | 343/702 |

FOREIGN PATENT DOCUMENTS

| | | |
|---|---|---|
| 22843 | 1/1990 | Australia . |
| 0 747 990 A1 | 12/1996 | European Pat. Off. . |
| 2 185 635 | 7/1987 | United Kingdom . |

OTHER PUBLICATIONS

J. Holland, "Multiple Feed Antenna: Covers L, S, and C Band Segments", *Microwave Journal*, Oct. 1981, pp. 82–85.

*Primary Examiner*—Hoanganh Le

*Attorney, Agent, or Firm*—Richard K. Clark; Daniel W. Juffernbrach

[57] ABSTRACT

A first coil (110) resonant at a first frequency, and a second coil (120) resonant at a second frequency, coupled to a conductive straight portion (140) of an antenna element (130) to form a multi-band antenna structure. The first and second coils (110) and (120) are preferably of different axial lengths and circumferences, wound in opposite directions and coaxially disposed about the antenna element (130). Additional coils can be added to accommodate additional bands and an upper coils (150) can be used to realize a multi-position structure.

20 Claims, 5 Drawing Sheets

MULTI-BAND ANTENNA STRUCTURE FOR A PORTABLE RADIO

BACKGROUND OF THE INVENTION

1. Technical Field

The present invention relates to antennas, and, more particularly, relates to coils for feeding multi-band antenna structures.

2. Description of the Related Art

A helical coil for coupling to an extendible, straight-wire antenna is known in the art, by, for example, U.S. Pat. No. 4,121,218 to Irwin et al. The helical coil and extendible straight-wire are dimensioned for resonance in a particular frequency band of a portable radio such as a cellular telephone.

As different analog and digital cellular telephone systems are promulgated throughout the world, antennas corresponding to each of the different cellular systems are known. Cellular telephone subscriber users who travel through different systems or who use a cellular telephone in a geographical area with more than one system, desire a single cellular telephone usable on more than one system. Communication on differing bands of frequencies in the same radio is therefore desired. Because antennas of different bands for the same cellular telephone could likely be inconvenient for a user, a single antenna structure capable of operation at more than one band is desired.

New designs of cellular telephones are evolving to satisfy user convenience. Most users appreciate small packages which are convenient to carry and use. A multi-band antenna structure of a compact design, while achieving low manufacturing costs, is desired.

Achieving both a compact and multi-band antenna structure capable of the high gain performance of prior single band antenna structures has been difficult. Known antenna structures optimized for maximize gain in one band have design characteristics yielding sub-optimal gain at other bands. Antenna gain performance equal to or better than existing single-band antennas is desired for all bands in a single, compact, antenna structure. Such has not heretofore been possible before the present invention which will be explained below with reference to the accompanying drawings.

DETAILED DESCRIPTION OF THE PREFERRED EMBODIMENTS

Figure 1:
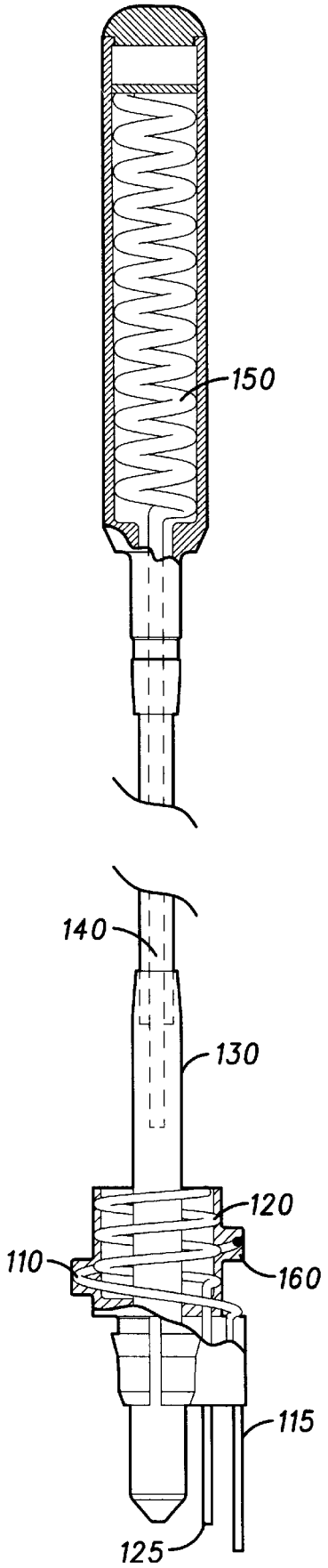
FIG. 1 illustrates a cut-away side view of an embodiment of an antenna structure in an up position.

The present invention provides a single, compact antenna structure capable of resonance at more than one frequency band. A first coil corresponding to a first band and a second coil corresponding to a second band are disposed adjacent to a straight portion of an antenna element in a configuration resonant at the respective first and second frequency bands. By placing these first and second coils both coaxial with the straight portion of the antenna element, a more compact structure is realized.

It has been discovered that more efficient gain performance in the band can be achieved by reducing coupling between the coils. Winding two coaxial coils in opposite directions is preferred to reduce coupling interference. Additionally, making one coaxial coil large in diameter than another coaxial coil also reduces coupling interference, and providing the shorter linear length coil on the outside reduces such interference even more.

A first coil 110 and a second coil 120 are illustrated coaxially disposed around an antenna element 130 having a straight portion 140. The first coil 110 and the second coil 120 are preferable helical coils. The antenna element 130 preferably has an upper coil 150 at an upper end thereof and is encapsulated by a dielectric material. The first coil 110 and the second 120 are preferably held in a base 160 made of a dielectric material.

Coupling interference between coils reduces gain efficiency of the antenna structure because energy that should be coupled between the straight portion and the coil of interest is instead coupled to the other coil. When energy is transmitted from the antenna structure, preferably all of the energy radiates from the straight portion. For example, when the antenna structure is used in a radio to transmit radiation energy at a first frequency band by the first coil 110, it is desired that all of the radiation energy radiates from the straight portion 140 of the antenna element 130. Nevertheless, some of the energy will radiate from the first coil itself 110 and additionally be coupled from the first coil 110 to the second coil 120 thereby absorbed by radio circuitry connected to the second coil 120. Energy radiated by the coil 110 and absorbed by the additional coil 120 dissipates power producing inefficient operation of the antenna structure. By making the first coil 110 of a larger circumference and therefore on the outside of the second coil 120, coupling interference is reduced. Further, by placing the coil having a shorter axial length on the outside, coupling interference is further reduced. The linear length is the total length of the coil if uncoiled and stretched out linearly. The axial length is the length axially along the line formed by the straight portion 140 of the antenna element 130. Thus, in FIG. 1, the first coil 110 has about half the axial length of the second coil 120 but very roughly the same linear length as the second coil 120. However, when stretched out, the linear length of the first coil 110 is preferably smaller than the second coil 120 because the first coil preferably resonates at a first frequency band higher than the second coil resonates at a second frequency band.

It has also been discovered that by winding the first and second coils 110 and 120 in opposite directions, coupling is additionally reduced when coaxial with one another as illustrated in FIG. 1. The direction of the turns of the helical coils relative to one another is preferably opposite to cause subtraction of electrical and magnetic field vectors and thus minimize coupling. By the turns being opposite in direction, the magnetic field of one coil is negative with respect to the other coil.

The first coil 110 has an axial length of about 3.5 millimeters (about 0.138 inches), and a linear length of about 22.5 millimeters (about 0.886 inches). These preferable dimensions for the first coil 110 are coupled to the antenna element 130 having a total length of about 76 millimeters (about 2.99 inches) and a conductive straight portion 140 of about 48.5 millimeters (about 1.91 inches) and an upper coil 150 having an axial length of about 27.5 millimeters (about 1.08 inches), a circumference of about 14.2 millimeters (about 0.559 inches) and a linear length of about 163 millimeters (about 6.42 inches). The first coil 110 operating with the antenna element 130 thus resonates at about 1800 megahertz.

The second coil 120 preferably has an axial length of about 6.0 millimeters (about 0.236 inches), a circumference of about 23 millimeters (about 0.906 inches) and a linear length of about 66 millimeters (about 2.6 inches). The second coil 120, when operating with the above-described preferred antenna element 130, resonates at a frequency band of about 920 megahertz. The distance between the lower end of the conductive straight portion 140 of the antenna element 130 preferably is spaced about 1.0 millimeters (about 0.039 inches) from the upper end of the second coil 120 when the antenna element 130 is in the upper position as illustrated in FIG. 1.

The first coil 110 is connected to the transceiver of a radio by feed 115 and the second coil 160 is fed to the transceiver of a radio by feed 125. The relative dielectric constant of the base 160 is preferably about 2.3 and the relative dielectric constant of the antenna element 130 should be about the same in the preferred embodiment.

The straight wire 140 of the antenna element forms a dipole. When the straight wire 140 is positioned near the helical coils in an up position, the antenna element is simultaneously resonant at an integral multiple of ½ of a wavelength at the lower frequency one of the bands and at a same or greater integral multiple of ½ of a wavelength at the higher frequency one of the bands. When the upper coil is positioned near the helical coils, in a down position, the upper coil of the antenna element is simultaneously resonant at an integral multiple of a ¼ of a wavelength at the lower frequency one of the bands and an integral multiple of a ¼ of a wavelength at the higher frequency one of the bands.

Figure 2:
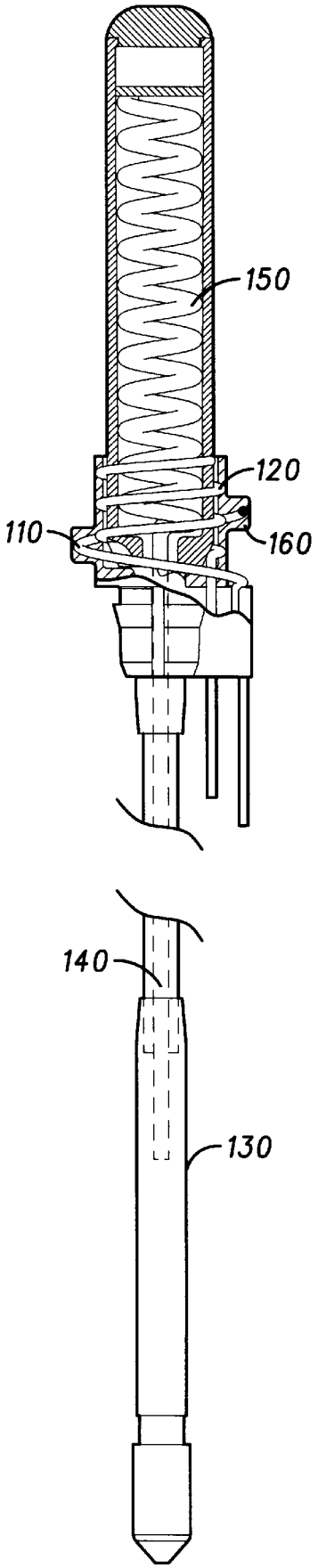
FIG. 2 illustrates a cut-away side view of an embodiment of the antenna structure of FIG. 1 in a down position.

FIG. 2 illustrates a cut-away side view of the antenna structure of the embodiment of FIG. 1 in a down position. The upper coil 150 is coaxially disposed between both of the first coil 110 and the second coil 120 when in the down position of FIG. 2. By providing the upper coil 150, the axial length of the first and second coils 110 and 120 can be reduced for efficient operation in the down position. Should efficiency in the down position be unimportant, then the upper coil 150 can be reduced. Nevertheless, to enhance efficiency in the down position, the upper coil 150 can be eliminated anyway if the lengths of the first and second coils 110 and 120 are increased to compensate for the loss of the radiator in the upper coil 150. Therefore, the upper coil 150 is optional and preferred under certain circumstances.

Figure 3:
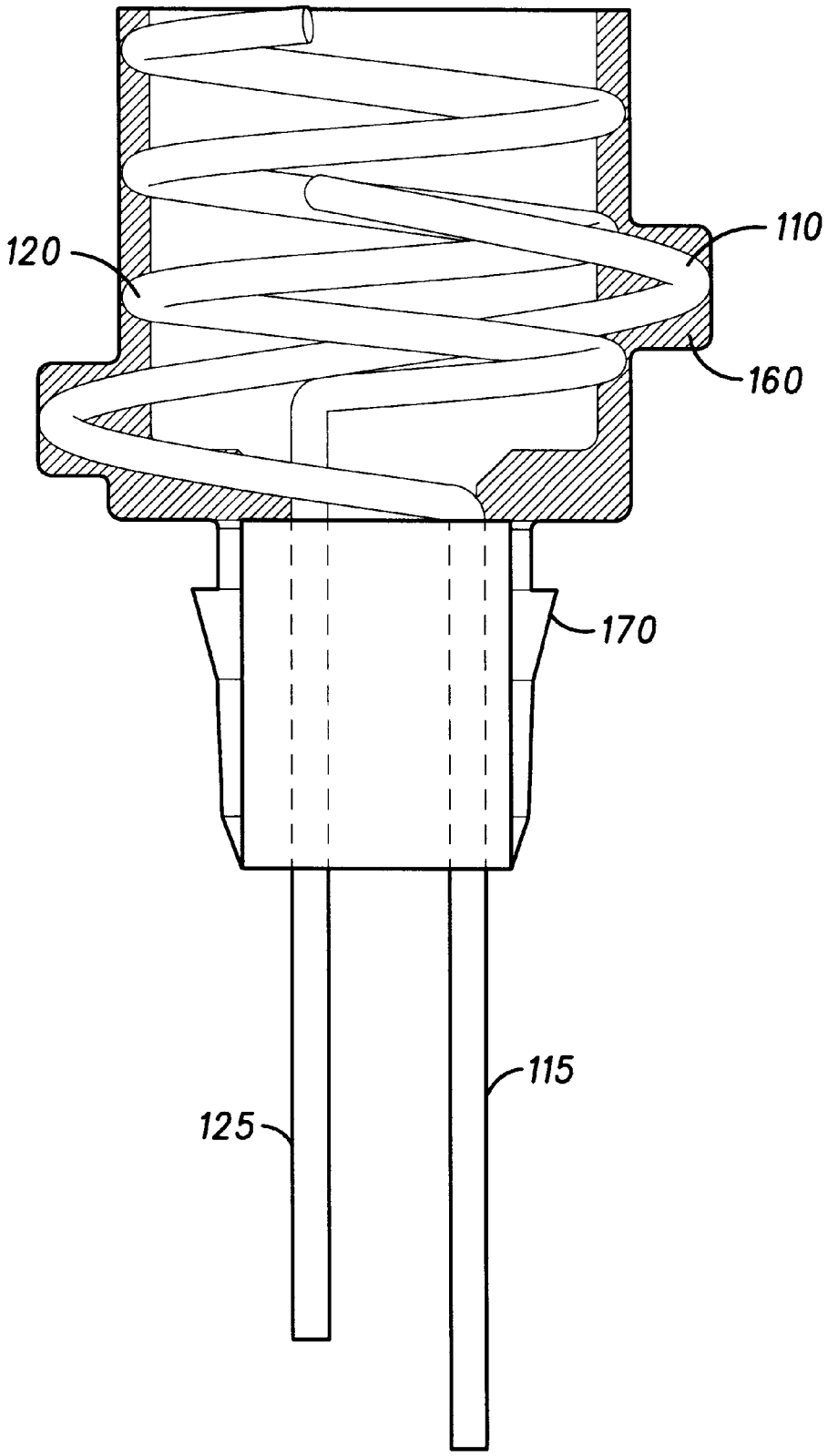
FIG. 3 illustrates a close-up cut-away view of two helical coils alone.

FIG. 3 illustrates a close-up cut-away view of two helical coils. The first coil 110 and the second coil 120 are wound on the base 160. The coils 110 and 120 are preferably not embedded in a thick plastic enclosure of the dielectric material of the base 160. It is rather, preferred that the dielectric material of the base 160 is as thin as practical while still maintaining structural integrity of the base and coils. Extra dielectric material near the coils affects antenna performance. Further, it adds unnecessary weight and size to the antenna structure. The base 160 contains an annular flange 170 at a lower portion thereof. This annular flange 170 serves to secure the antenna assembly into the top of a housing of a portable radio, such as a radiotelephone. The first feed 115 and the second feed 125 then connect internal to the radiotelephone to separate transmitters—one transmitter each for the various bands.

Figure 4:
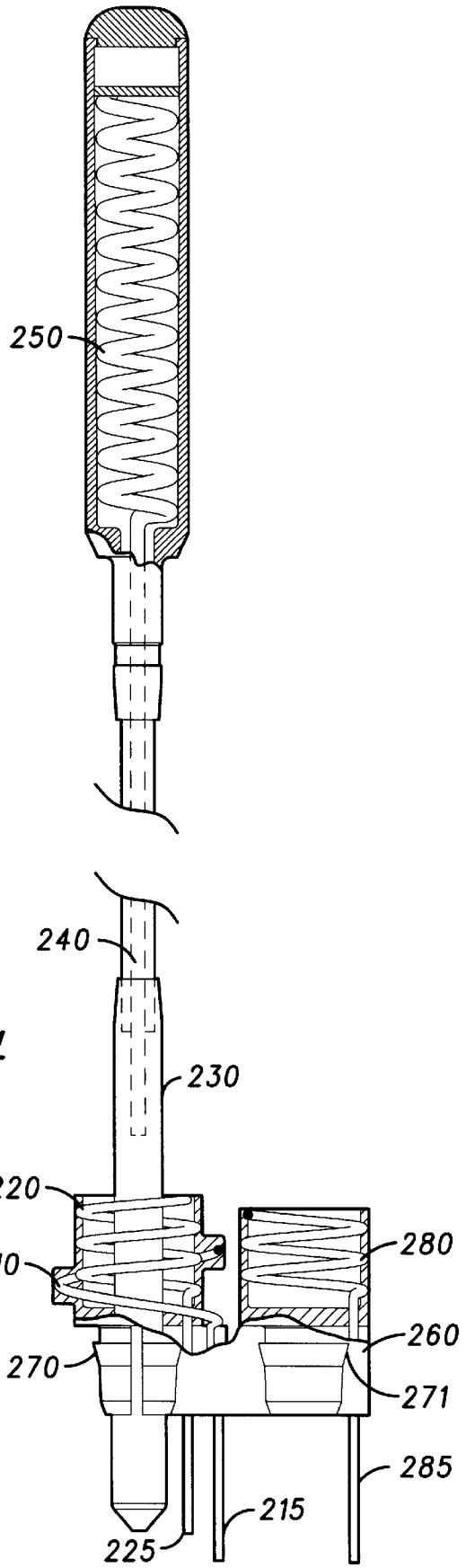
FIG. 4 illustrates a cut-away view of another embodiment of an antenna structure in an up position.

FIG. 4 illustrates a cut-away side view of another embodiment of an antenna structure in an up position. A third coil 280 is disposed adjacent to a first coil 210 and a second coil 220. An antenna element 230 having a conductive straight portion 240 and an upper helix 250 is coaxially disposed with the first and second coils 210 and 220. The first, second and third coils 210, 220 and 280 provide for resonance at different first, second and third frequency bands. The third coil 280 is preferably disposed alongside, rather than coaxial, with the first and second coils 210 and 220 to reduce coupling interference therebetween. It has been discovered that the distance between the third coil 280 and the second coils 210 and 220 affects the amount of coupling interference therebetween. The third coil 280 is spaced from the coils 210 and 220 by a distance to avoid coupling interference. The third coil 280 is preferably beside the first and second coils 210 and 220 distanced therefrom by an amount sufficient to reduce coupling to the first and second coils 210 and 220, yet still maintain adequate coupling to the conductive straight portion 240 of the antenna element 230.

The base 260 preferably has a minimum amount of dielectric material to reduce its affects on the first, second and third coils 210, 220 and 280. Thus, an air gap in the distance between the coil 280 and the first and second coils 210 and 220 is preferred. In the preferred embodiment of FIG. 4, the base 260 has separate annular recesses 270 and 271 for mounting to the top portion of a portable radio and openings for respective first, second and third feeds, 215, 225, and 285.

Coupling accomplished via an electric field is related to and correctly described as capacitive coupling. Coupling accomplished via a magnetic field is related to and correctly described as inductive coupling. The electric and magnetic field coupling are vector quantities and often occur simultaneously. Thus their vector quantities can be added or subtracted and as such can reinforce one another or can cancel one another. It has been discovered that by geometrically arranging multiple helical coils side-by-side, the electric and magnetic (capacitive and inductive) vector quantities can be made to add and subtract to reduce electromagnetic coupling with the other helical coils and enhance electromagnetic coupling with the conductive straight portion. The combination of the electric and magnetic fields is an electromagnetic field. Each of the coils are spaced a mast distance from the bottom of the straight portion 240.

Electric field coupling decreases inversely as the distance between the coils increases. Magnetic field coupling also decreases as the distance between the coils increases. But the magnetic field coupling decreases more rapidly than the electric field coupling with respect to the distance between the coils. The magnetic field decreases as the square of the coil distance assuming mathematical approximations valid in the small distances in the sizes used in portable devices. Thus, the coil 280 is are preferably distanced from the coils 210 and 220 where the magnitude of the electric and magnetic field coupling are equal.

The bottom end of the conductive straight portion 140 is placed near the upper ends of the coils. The mast distance of separation between the bottom end of the conductive straight portion and the upper ends of the helical coils determines the magnitude of electric field coupling. The greater the separation, the lower the electric field coupling. This antenna structure is preferably first approximated by electromagnetic simulation on a computer using computer programs such as the Numerical Electromagnetic Code (NEC 4.0) and then perfected by fine tuning a physical model in the laboratory. Correct coupling is indicated in both antenna gain performance and the input impedance of the antenna measured as a function of frequency. The best coupling condition occurs when a minor cusp appears in the normally circular impedance plot on a Smith chart as the mast distance between the conductive straight portion 240 and the coils is varied. This mast distance can be found by moving the bottom end of the conductive straight portion towards the top of a helical coil until this minor cusp appears.

Figure 5:
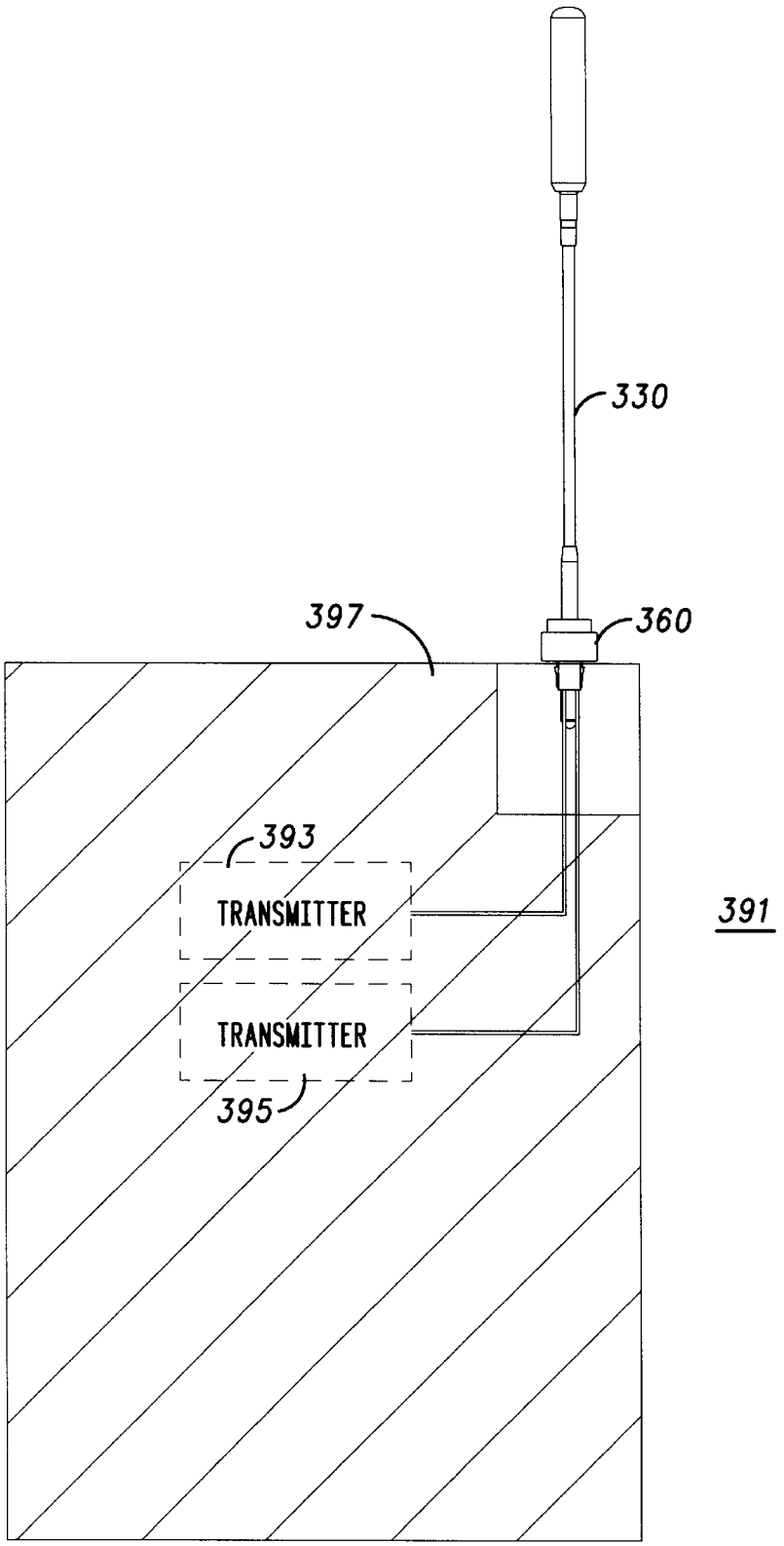
FIG. 5 illustrates a multi-band radiotelephone.

FIG. 5 illustrates a multi-band radiotelephone 391 having a multiband capability. The base 360 is mounted to a top portion of a portable radiotelephone 391. The antenna element 330 is slidably disposed in the base 360. The multi-band radiotelephone 391 has multiple transmitters 393 and 395, one transmitter for each band. A hot output of a first transmitter 393 is connected to a first coil in the base 360. A ground output of this first transmitter 393 is preferably connected to a ground plane portion 397 of the radiotelephone 391. A hot output of a second transmitter 395 is preferably connected to a second coil of the base 360. The ground output of the second transmitter 395 is preferably also referenced to ground such as a different or the same ground plane 397 of the radiotelephone 391. Therefore, each coil of the antenna structure corresponds to a different frequency of a transmitter. It is understood that the transmitters 393 and 395 can alternatively be receivers and/or transceivers. Further, a single radio circuit can be employed, capable of multiple-band operation and therefore separate transmitters 393 and 395 may be unnecessary.

Although the invention has been described and illustrated in the above description and drawings, it is understood that this description is by example only, and that numerous changes and modifications can be made by those skilled in the art without departing from the true spirit and scope of the invention. For example, different configurations of upper coils may be employed based on packaging requirements. The U.S. patent application Ser. No. 08/803,032, entitled Side-By-Side Coil-Fed Antenna For a Portable Radio to Phillips et al. and filed on Feb. 19, 1997 is specifically incorporated herein by reference.

What is claimed is:

1. A multi-band antenna structure, comprising:

an antenna element having a straight portion;

a first coil coaxially disposed around the straight portion for electromagnetic coupling to the antenna element, the first coil having a first number of turns of a first circumference wound in a first direction and configured for resonance at a first frequency band, wherein the first circumference is smaller than a wavelength of the first frequency band;

a second coil coaxially disposed around the straight portion for electromagnetic coupling to the antenna element, the second coil having a second number of turns of a second circumference wound in a second direction and configured for resonance at a second frequency band different than the first frequency band, wherein the second direction is essentially opposite of the first direction and the second circumference is smaller than a wavelength of the second frequency band; and wherein the first coil and the second coil are coaxial with one another, the first circumference of the first coil is larger than the second circumference of the second coil, the first coil has an axial length shorter than the second coil, and the first coil has a linear length shorter than the second coil.

2. A multi-band antenna structure according to claim 1, wherein the first coil and the second coil have a different number of turns.

3. A multi-band antenna structure according to claim 1, wherein each of the first coil and the second coil are pitched and form a helix.

4. A multi-band antenna structure according to claim 1, further comprising a third coil configured for resonance at a third frequency band different than the first and second frequency bands and having a third number of turns of a third circumference smaller than a wavelength of the third frequency band, wherein the third coil is disposed beside the antenna element having the straight portion and distanced from the first and second coils to reduce electromagnetic coupling with the first and second coils.

5. A multi-band antenna structure according to claim 1, wherein the straight portion of the antenna element comprises a straight wire electromagnetically coupled to the first coil and the second coil.

6. A multi-band antenna structure according to claim 5, wherein the antenna element comprises an upper helical coil connected to the straight wire at an upper end.

7. A multi-band antenna structure according to claim 5, wherein the straight wire of the antenna element comprises a dipole.

8. A multi-band antenna structure according to claim 7, wherein the antenna element is simultaneously resonant at an integral multiple of ½ of a wavelength at the lower frequency one of the bands and at a same or greater integral multiple of ½ of a wavelength at the higher frequency one of the bands when the straight wire is in an up position near the first coil and the second coil.

9. A multi-band antenna structure according to claim 5, wherein the antenna element comprises an upper helical coil operatively coupled to the straight wire at an upper end.

10. A multi-band antenna structure according to claim 9, wherein the upper coil of the antenna element is simultaneously resonant at an integral multiple of a ¼ of a wavelength at the lower frequency one of the bands and an integral multiple of a ¼ of a wavelength at the higher frequency one of the bands when the upper helical coil is in a down position near the first coil and the second coil.

11. A multi-band antenna structure according to claim 9, wherein the upper helical coil is axially positioned inside both the first coil and the second coil when the antenna element is in a down position.

12. A multi-band antenna structure according to claim 5, wherein the straight wire is near a top of the first and second coils when the antenna element is in an up position.

13. A multi-band antenna structure according to claim 1, further comprising a radio circuit operatively coupled to the first coil and the second coil for amplifying respective radio frequency signals at the first band and at the second band.

14. A multi-band antenna structure according to claim 13, wherein the radio circuit comprises a ground plane operatively coupled to a ground connection of the radio circuit, wherein a first hot connection of the radio circuit is operatively coupled to the first coil and wherein a second hot connection of the radio circuit is operatively coupled to the second coil.

15. A portable radio, comprising:

an antenna element having a straight portion;

a first coil coaxially disposed around the straight portion for electromagnetic coupling to the antenna element, the first coil having a first number of turns of a first circumference wound in a first direction and configured for resonance at the first frequency band, wherein the first circumference is smaller than a wavelength of the first frequency band;

a second coaxially disposed around the straight portion for electromagnetic coupling to the antenna element, the second coil having a second number of turns of a second circumference wound in a second direction and configured for resonance at a second frequency band different than the first frequency band, wherein the second direction is essentially opposite of the first direction and the second circumference is smaller than a wavelength of the second frequency band;

wherein the first coil and the second coil are coaxial with one another, the first circumference of the first coil is larger than the second circumference of the second coil, the first coil has an axial length shorter than the second coil, and the first coil has a linear length shorter than the second coil;

a first radio circuit for operating at the first frequency band and comprising a first hot connection and a first ground connection, wherein the first hot connection is operatively coupled to the first coil; and a second radio circuit for operating at the second frequency band and comprising a second hot connection and a second ground connection, wherein the second hot connection is operatively coupled to the second coil.

16. A multi-band antenna structure, comprising:

a first coil having a first number of turns of a first circumference wound in a first direction and configured for resonance at a first frequency band, wherein the first circumference is smaller than a wavelength of the first frequency band; and a second coil having a second number of turns of a second circumference wound in a second direction and configured coaxially with the first coil and inside of the first coil for resonance at a second frequency band different than the first frequency band, wherein the second direction is essentially opposite of the first direction, the second circumference is smaller than a wavelength of the second frequency band, and the second circumference is smaller than the first circumference; and wherein the first coil has an axial length shorter than the second coil and the first coil has a linear length shorter than the second coil.

17. A multi-band antenna structure according to claim 16, wherein the first coil and the second coil have a different number of turns.

18. A multi-band antenna structure according to claim 16, wherein each of the first coil and the second coil are pitched and form a helix.

19. A multi-band antenna structure according to claim 16, further comprising a radio circuit operatively coupled to the first coil and the second coil for amplifying respective radio frequency signals at the first band and at the second band.

20. A multi-band antenna structure according to claim 16, further comprising a straight portion coaxially disposed with respect to the first coil and to the second coil for electromagnetic coupling with both of the first coil and the second coil.

* * * * *